US006796553B2

(12) United States Patent
Hampel

(10) Patent No.: US 6,796,553 B2
(45) Date of Patent: Sep. 28, 2004

(54) ARRANGEMENT FOR APPLYING AND PRESSING ON COVERS

(75) Inventor: Klaus Hampel, Bielefeld (DE)

(73) Assignee: Kolbus GbmH & Co. KG, Rahden (DE)

( * ) Notice: Subject to any disclaimer, the term of this patent is extended or adjusted under 35 U.S.C. 154(b) by 0 days.

(21) Appl. No.: 10/464,198

(22) Filed: Jun. 18, 2003

(65) Prior Publication Data

US 2004/0052614 A1 Mar. 18, 2004

(30) Foreign Application Priority Data

Jun. 22, 2002 (DE) ..... 102 27 950

(51) Int. Cl.[7] ..... B42V 11/02

(52) U.S. Cl. ..... 270/52.18; 270/58.07; 412/19

(58) Field of Search ..... 270/58.07, 58.08, 270/52.18; 412/19, 22, 23

(56) References Cited

U.S. PATENT DOCUMENTS

| | | | | | |
|---|---|---|---|---|---|
| 4,080,678 | A | * | 3/1978 | Muller | 412/13 |
| 4,153,963 | A | | 5/1979 | Hawkes et al. | |
| 4,491,448 | A | * | 1/1985 | Anders et al. | 412/21 |
| 4,710,256 | A | * | 12/1987 | Ladewig et al. | 156/484 |
| 5,141,377 | A | * | 8/1992 | Rathert | 412/22 |
| 5,429,468 | A | * | 7/1995 | Kojima | 412/19 |
| 6,168,363 | B1 | * | 1/2001 | Nehring | 412/30 |
| 6,497,544 | B1 | * | 12/2002 | Schmucker et al. | 412/17 |
| 6,575,445 | B1 | * | 6/2003 | Garlichs et al. | 270/52.18 |
| 6,676,354 | B2 | * | 1/2004 | Holtmeier et al. | 412/6 |

FOREIGN PATENT DOCUMENTS

| | | |
|---|---|---|
| CH | 433 186 | 9/1967 |
| DE | 33 40 859 C 2 | 5/1985 |
| DE | 37 41 989 A 1 | 7/1988 |

* cited by examiner

*Primary Examiner*—Patrick Mackey
(74) *Attorney, Agent, or Firm*—Alix, Yale & Ristas, LLP

(57) ABSTRACT

A device for a bookbinding machine for applying and pressing a cover (3) on to an inner book (2) which is continuously transported in feed direction (F) comprises a vertically-movable back pressing plate (4*a,b*) mounted on a support plate (7) for pressing the cover (3) on to the back, and comprises horizontally displaceable side pressing bars (5, 6) mounted in bearings on the support plate (7) and controlled by an actuating arrangement for pressing against side faces adjacent to the back, the back pressing plate (4*a,b*) and the side pressing bars (5, 6) being able, in a cyclical reciprocating movement (H), to be advanced synchronously with the transported inner book while pressing against same and being guided at a distance from the back in the reverse movement. To limit the opening of the side pressing bars during the full reciprocating movement, it is provided in a simple construction that the actuating arrangement includes connecting rods (17, 18) which are pivoted at pivot points (17*a*, 18*a*) outside the reciprocating support plate (7) and are pivotally connected by their other ends to the side pressing bars (5, 6) directly or via an intermediate transmission (19, 20) which moves with the support plate (7), and that the outwardly-located pivot points (17*a*, 18*a*) are displaceable in a guided manner along the feed direction (F) of the inner book transporting system. In addition, the device makes it possible to set a particular opening width of the side pressing bars during the upward movement of the back pressing plate.

17 Claims, 2 Drawing Sheets

ARRANGEMENT FOR APPLYING AND PRESSING ON COVERS

BACKGROUND OF THE INVENTION

The present invention relates to a device for a bookbinding machine for applying and pressing on a cover.

In adhesive binding an inner book (comprising a multiplicity of printed sheets cut and glued along the back and continuously advanced in a conveyor system), is joined to a cover which was previously separated from a stack, then scored and fed in an aligned manner to the inner book. The cover is pressed in the so-called press-applicator against the back of the inner book and the side faces adjacent thereto by means of synchronously moving pressing bars during the continuous movement of the inner book.

Known, for example, from U.S. Pat. No. 4,153,963 is an arrangement in which the back pressing plate is moved cyclically in a horizontal reciprocating manner by means of a crank mechanism having two cranks arranged parallel to one another, while the pivots of the cranks are moved up and down by controlled movements of eccentrics. The side pressing bars are guided horizontally in bearings, transversely to the horizontal reciprocating motion, in a support plate of the back pressing plate, and are moved towards and away from the inner book by connecting rods having fixed pivots in a parallel crank arrangement during the horizontal reciprocating motion, the opening width as the distance between the side pressing bars being very large in their outer reversal positions. For adaptation to inner books of different thicknesses, one of the two side pressing bars has a telescopically adjustable configuration and its connecting rods are resiliently coupled to the frame.

DE 33 40 859 C2 describes an arrangement having a movable carriage supporting the back pressing plate, which carriage is horizontally movable in a guide sledge which executes a vertical movement, the movement of the side pressing bars towards the inner book during the horizontal motion of the movable carriage being executable by means of laterally arranged guide tracks together with guide rollers associated with the side pressing bars. The opening width of the side pressing bars in their outer reversal position is optimally defined, so that during processing of reinforcing strips said strips do not pass between the side pressing bars and are then crumpled, and so that the guide and support rails of the cover feed mechanism can be positioned close to the inner book for the processing of narrow covers. By displacing the guide tracks along the inner-book feed direction the opening width during the upward movement of the back pressing plate is adjustable. When pressing on a reinforcing strip, unlike the cover, the side pressing bars must be positioned close to the inner book so that the reinforcing strip is drawn tightly around the inner book.

This adjustment, however, can be made only at a standstill and requires a long phase in which the horizontal movement of the back pressing plate matches that of the inner book conveyor. Furthermore, the timing of the pressing by the side pressing bars is displaced relatively to the vertical movement of the back pressing plate. In the last-mentioned arrangement the actuating devices for the side pressing bars are arranged on the moving system. The maximum cycling speed is limited by the high mass, and the adjustment of the side pressing bars with respect to inner book thickness and to the projecting portion of the spine in general is complicated. In the first-mentioned arrangement, adjustment of the opening width is not provided and the adjustment of the telescopic side pressing bar in relation to the inner book thickness is possible only from outside, and is realised by a complex and expensive transmission of the rotary adjusting movement via universally jointed shafts. Because of the parallel crank arrangement the side pressing bars have only a short time to act on the inner book. The arrangement makes possible high cycling speeds.

SUMMARY OF THE INVENTION

It is the object of the present invention to provide a device for applying and pressing on a cover, having simple construction and comprising side pressing bars which open to a limited degree during the full reciprocating motion and can be set to a specific opening width during the upward movement of the back pressing plate.

The inventive concept lies in using connecting rods pivoted outside the carrier plate to actuate the side pressing bars, which connecting rods move the side pressing bars towards and away from the inner book during the reciprocating motion of the carrier plate and the back pressing plate, the outwardly-located pivot points being guided displaceably along the feed direction of the inner book conveyor. Essentially, the pivot points are entrained with the reciprocating movement over a partial section of its travel. The circular movement path of the side pressing bars, especially at the beginning and end, is thereby changed in such a way that the side pressing bars are not moved too far from the inner book and require only a limited range of movement. At the same time the side pressing bars are able to apply pressure for a longer period. The moving mass of the reciprocating pressing elements is kept low.

The outwardly-located pivot points are advantageously not arranged on the elements of the device which execute the vertical motion. The moving mass of the pressing elements is thereby further reduced.

Further advantages of the device according to the invention are the adjustments of the side pressing bars in relation to the inner book thickness and in relation to the projecting spine portion on the fixed-format side, which can be carried out from outside in a simple manner even while the machine is running, and the adjustment of the opening width during the upward movement of the back pressing plate. The device is suited to the manufacture of brochures having reinforcing strips and of lay-flat brochures.

BRIEF DESCRIPTION OF THE DRAWINGS

The invention will now be explained in more detail with reference to an embodiment illustrated in the drawings. In the drawings, which show the device according to the invention with schematic representation of the transmission mechanism.

DESCRIPTION OF THE PREFERRED EMBODIMENT

Figures 1, 4:
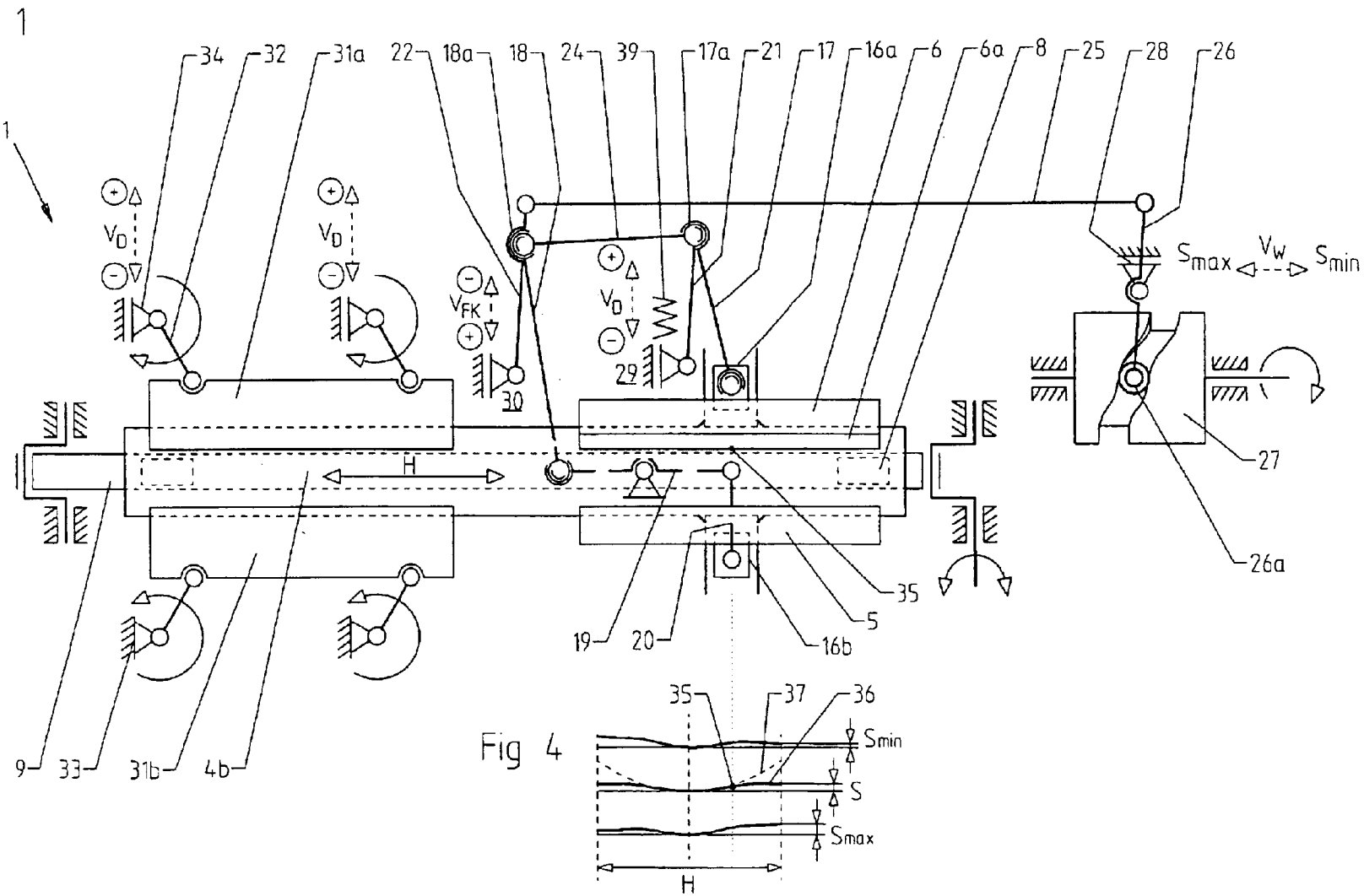
FIG. 1 shows the device in plan view.
FIG. 4 is a diagram showing the movement paths of a point on a side pressing bar for differently adjusted opening widths.
Figure 2:
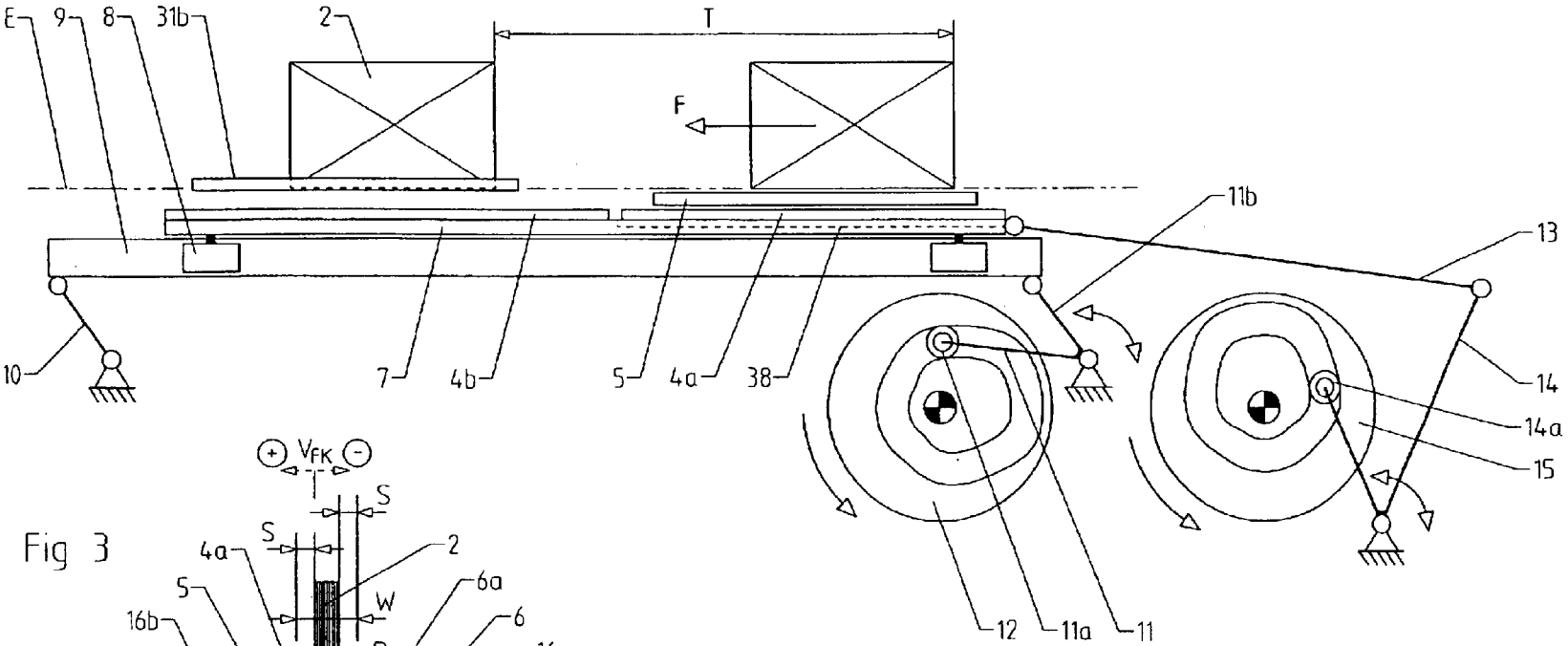
FIG. 2 shows the device in a side view.

The device 1 for applying and pressing on covers forms part of an adhesive binding machine (not illustrated here in detail) in which an inner book 2 comprising a multiplicity of printed sheets, which has been cut and glued along the back and is continuously advanced in a conveyor system in a feed direction F and with a cycling distance T, is joined to a cover 3 which is previously separated from a stack, then scored and fed in an aligned manner to the inner book 2. As this happens, the cover 3 is pressed against the back and the side faces adjacent to the back of the inner book 2, which has an inner-book thickness D and is located in a transport plane E, by means of synchronously-moving pressing bars 4*a,b*, 5, 6, 31*a,b*.

The device 1 for applying and pressing on covers has a two-part back pressing plate 4*a,b* carried by a support plate 7 and guided to reciprocate horizontally by means of linear guides 8 in a vertically reciprocating guide sledge 9, the absolute motion of the back pressing plate 4*a,b* describing a closed curve along which it passes cyclically in synchronisation with the transported inner book 2. The guide sledge 9 is coupled in a parallel-link arrangement to a pivoted arm 10 and to a cam lever 11 having a pivoted arm 11*b* and is caused to perform vertical movements by the cam lever 11 which engages in a cam disc 12 via its associated follower roller 11*a*, the plane of the linear guides 8 always being disposed parallel to the transport plane E. Superimposed on the vertical movement is a horizontal movement which is transmitted as a travel distance H to the linearly-guided support plate 7 via a connecting rod 13 by a cam lever 14 which engages in a cam disc 15 via a follower roller 14*a*.

The length of the back pressing plate 4*a,b* extends over two cycles, so that it acts on the back of an inner book 2 in two successive cycles. In the first section, the rear section as seen in the feed direction F, horizontally displaceable side pressing bars 5, 6, are mounted in bearings on the support plate 7 via linear guides 16*a,b* and are controlled to move transversely to the feed direction F towards and away from the inner book 2 in order to press against side faces of said inner book 2 adjacent to the back. For this purpose connecting rods 17, 18 are attached to the side pressing bars 5, 6 via ball-joints 23, and are coupled to pivoted levers 21, 22 outside the reciprocating support plate 7 at pivot points 17*a*, 18*a*. To enable arrangement of the pivoted levers 21, 22 on one side of the device 1, an intermediate transmission is provided which transmits the control movement to the side pressing bar 5 on the opposite side via an intermediate lever 19 journalled on the support plate 7 and via a further connecting rod 20.

Because of the geometrical arrangement, to be seen in FIG. 1, of the pivoted levers 21, 22 with the pivot points 17*a*, 18*a* for the connecting rods 17, 18 in relation to the coupling of the connecting rods 17, 18 to the reciprocating system, the side pressing bars 5, 6 are at a distance from the inner book 2 in the rear and front reversal positions of the reciprocating back pressing plate 4*a,b*, while they are positioned against the inner book 2 at approximately the centre of the movement of the back pressing plate 4*a,b*. If fixed pivoted levers 21, 22 were used, a movement path 37 represented in FIG. 4 would be produced for a point 35 on the side pressing bar 6. In particular in their reversal positions, the side pressing bars 5, 6 would be spaced very far from the inner book 2. A reinforcing strip could pass between the very widely-opened side pressing bars 5, 6 and would then be crumpled. These strips are small papers, which are a little wider/broader than the thickness of the inner book. The strips have to be drawn tightly around the inner book by the first side pressing bars 5,6. If the opening width W is too wide the reinforcing strips fall between the side pressing bars. The side pressing bars would then crumple the strip instead of drawing it around the inner book. The opening width W must be only a little wider than the thickness of the inner book to assure that the reinforcing strip always lies on the side pressing bars.

Figure 3:
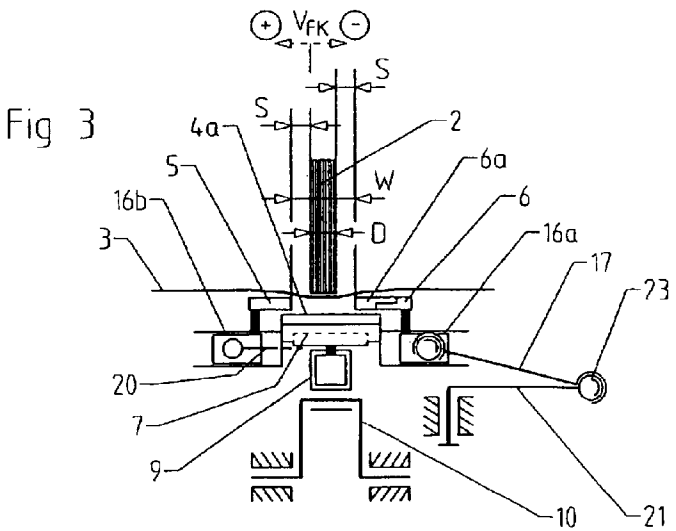
FIG. 3 shows the device in a front view (from the right of FIGS. 1 and 2)

To restrict the opening width W as the distance between the side pressing bars 5, 6, the outwardly-located pivot points 17*a*, 18*a* are guided essentially displaceably along the feed direction F of the inner book 2 and along the horizontal movement of the support plate 7 by swivelling of the pivoted levers 21, 22 via their associated pivots 29, 30, so that the movement path 36 represented in FIG. 4 with an optimum gap width S between the side pressing bars 5, 6 and the inner book 2 is produced. For this purpose the two pivoted levers 21, 22 are connected together via a connecting rod 24 and are connected via a connecting rod 25 to a cam lever 26 to which controlled swivelling movements are imparted by the engagement of its follower roller 26*a* in the groove of a drum-type cam 27. This arrangement "guides" the pivot points 17*a* and 18*a* so as always to remain in a horizontal plane corresponding to the sheet of paper in FIG. 1, and into and out of the paper in FIG. 3 (i.e., on the plane defined by the angular rotation of 21 about a vertical axis as shown in FIG. 3). In the embodiment shown in the Figures, the pivot points 17*a*, 18*a* move along a curved path, where the movement sector (area) is essentially along the feed direction F.

For the manufacture of certain types of products, e.g. brochures with reinforcing strips, it is necessary for the side pressing bars 5, 6 to be at a small gap distance $S_{min}$ from the inner book 2 during the upward movement of the back pressing plate 4*a,b*, in order to apply the reinforcing strip as tightly as possible around the back of the inner book. A large gap distance $S_{max}$ is desirable when especially stiff covers 3 are being processed, which covers, if the gap distance S were too small, would be moved out of their aligned position before being pressed against the inner book 2 by the back pressing plate 4*a,b*. In order to set a certain opening width W during the upward movement of the back pressing plate 4*a,b* the associated pivot 28 of the cam lever 26 is made adjustable, e.g. by mounting the pivot 28 on a rotatable eccentric spindle. The adjustment $V_W$ shown symbolically in FIG. 1 indicates the directions for small or large gap widths S.

The left-hand side, seen in the feed direction F (also see FIG. 3) has a fixed format in relation to the inner-book thickness D, while the right-hand side, as the variable-format side of the book, is adjustable with respect to thickness, in that the pivot 29 associated with the pivoted lever 21 is made adjustable transversely to the feed direction F. The adjustment $V_D$ represented symbolically in FIG. 1 indicates the directions for displacing the travel position of the side pressing bar 6 in relation to the inner-book thickness D. In the concrete embodiment this adjustment $V_D$ acts only within a small format range. Larger changes of thickness are carried out by exchanging an exchangeable part 6*a* of the side pressing bar 6. In addition to the adjustment $V_D$, the pivot 29 is effectively connected to a spring 39 whereby said side pressing bar 6 acts resiliently on the inner book 2. By means of the adjustment $V_{FK}$ of the pivot 30 of the pivoted lever 22 the fixed-format, left-hand side is also adjustable to correct the end position of the associated side pressing bar 5 in relation to the projecting back portion of the inner book 2.

The side pressing bars 5, 6, which act in the first section of the back pressing plate 4*a*, are required when manufacturing brochures having reinforcing strips, lay-flat brochures or the like. In the case of normal brochures, where the cover is first pressed only against the back of the inner book 2, they are not required and can be removed from the cover applying and pressing device 1, together with the corresponding part 4*a* of the back pressing plate, as an exchangeable table 38, and replaced by a table without side pressing bars. The dashed line 38 indicates the part of the support plate 7 that constitutes the exchangeable table 38 together with the back pressing plate 4*a* and the side pressing bars 5,6 journalled displaceably in the corresponding part of the support plate 7 (which belongs to the exchangeable table 38.

In the second section a further pair of side pressing bars 31*a,b* is provided to operate on the books after the first pair of side pressing bars. The second pair is moved in a guided manner by means of parallel crank drives formed from continuously driven cranks 32. The cranks 32 on the left-hand side are journalled in pivots 33 mounted rigidly to the frame while those on the right-hand side are journalled in pivots 34 which are adjustable with respect to the inner-book thickness D.

What is claimed is:

1. A device supported by a frame of a bookbinding machine for applying and pressing a cover onto an inner book which is continuously transported in a feed direction F, comprising:

a vertically-movable back pressing plate mounted on a support plate for pressing the cover on to the back of the inner book;

horizontally displaceable side pressing bars mounted in bearings on the support plate for pressing against side faces adjacent to the back of the inner book;

wherein the back pressing plate and the side pressing bars are drivable in a cyclical reciprocating movement H synchronously with the transported inner book while pressing against the inner book during forward movement and guided at a distance from the back during the reverse movement;

an actuating arrangement for driving the cyclical reciprocating movement, including connecting rods which are coupled at their one ends to respective pivot points outside the support plate and are pivotally connected at their other ends to respective of said side pressing bars directly or via an intermediate transmission which moves with the support plate; and means for displaceably guiding the pivot points outside the support plate essentially along the feed direction F.

2. Device according to claim 1, wherein the actuating drive arrangement includes separately driven elements for imparting vertical movement to the back pressing plate and horizontal movement to the side pressing bars;

the outwardly-located pivot points are arranged outside the elements of the device executing the vertical movement; and said pivot points are ball-joints that enable three-dimensional movements.

3. Device according to claim 2, wherein the pivot points are arranged on pivoted levers, and a cam drive and lever with associated connecting rods controls the pivoted levers.

4. Device according to claim 3, wherein the cam drive is mounted to the frame and the pivot of the cam lever is adjustable to change the pivot position of the pivoted levers and therefore to change the opening width W of the side pressing bars with respect to one another during the upward movement of the back pressing plate.

5. Device according to claim 4, wherein the pivot for one of the pivoted levers is mounted on the frame and is adjustable to adapt the travel position of the associated side pressing bar to the thickness D of the inner book.

6. Device according to claim 4, wherein the pivot of one pivoted lever is mounted on the frame and is adjustable to correct the end position of the associated side pressing bar in relation to the projecting back portion of the inner book.

7. Device according to claim 3, wherein the pivot for one of the pivoted levers is mounted on the frame and is adjustable to adapt the travel position of the associated side pressing bar to the thickness D of the inner book.

8. Device according to claim 3, wherein the pivot of one pivoted lever is mounted on the frame and is adjustable to correct the end position of the associated side pressing bar in relation to the projecting back portion of the inner book.

9. Device according to claim 2, wherein a part of the back pressing plate, together with a part of the support plate and the side pressing bars journalled displaceably therein, takes the form of an exchangeable table and is replaceable by a table without side pressing bars.

10. Device according to claim 2, wherein a lengthened back pressing plate acting simultaneously on two books and by side pressing bars controlled by a second pair of parallel crank drives, which second pair of side pressing bars are arranged to operate on the books after the first pair of side pressing bars, as seen in the feed direction F of the books.

11. Device according to claim 1, wherein the pivot points are arranged on pivoted levers, and a cam drive and lever with associated connecting rods controls the pivoted levers.

12. Device according to claim 11, wherein the cam drive is mounted to the frame and the pivot of the cam lever is adjustable to change the pivot position of the pivoted levers and therefore to change the opening width W of the side pressing bars with respect to one another during the upward movement of the back pressing plate.

13. Device according to claim 11, wherein the pivot for one of the pivoted levers is mounted on the frame and is adjustable to adapt the travel position of the associated side pressing bar to the thickness D of the inner book.

14. Device according to claim 11, wherein the pivot of one pivoted lever is mounted on the frame and is adjustable to correct the end position of the associated side pressing bar in relation to the projecting back portion of the inner book.

15. Device according to claim 1, wherein a part of the back pressing plate, together with a part of the support plate and the side pressing bars journalled displaceably therein, takes the form of an exchangeable table and is replaceable by a table without side pressing bars.

16. Device according to claim 15, wherein a lengthened back pressing plate acting simultaneously on two books and by side pressing bars controlled by a second pair of parallel crank drives, which second pair of side pressing bars are arranged to operate on the books after the first pair of side pressing bars, as seen in the feed direction F of the books.

17. Device according to claim 1, wherein a lengthened back pressing plate acting simultaneously on two books and by side pressing bars controlled by a second pair of parallel crank drives, which second pair of side pressing bars are arranged to operate on the books after the first pair of side pressing bars as seen in the feed direction F of the books.

* * * * *